US005088255A

United States Patent [19]

Emanuel

[11] Patent Number: 5,088,255

[45] Date of Patent: Feb. 18, 1992

[54] WINDOW AND DOOR GLAZING SYSTEM

[75] Inventor: Brian A. Emanuel, Merrill, Wis.

[73] Assignee: Lincoln Wood Products, Inc., Merrill, Wis.

[21] Appl. No.: 640,276

[22] Filed: Jan. 10, 1991

[51] Int. Cl.[5] ..... E06B 1/08; E06B 1/18

[52] U.S. Cl. ..... 52/395; 52/456; 52/461

[58] Field of Search ..... 52/403, 397, 398, 463, 52/716, 717, 718, 395, 475

[56] References Cited

U.S. PATENT DOCUMENTS

| | | | |
|---|---|---|---|
| 2,866,527 | 12/1958 | Schilling | 52/395 |
| 2,983,002 | 5/1961 | McEvoy et al. | 20/56.4 |
| 3,678,651 | 7/1972 | Hicks | 52/311 |
| 3,868,804 | 3/1975 | Tantlinger | 52/716 |
| 4,387,542 | 6/1983 | Wehr | 52/209 |
| 4,628,648 | 12/1986 | Winyard | 52/212 |
| 4,730,429 | 3/1988 | Roberts | 52/309.13 |
| 4,744,403 | 5/1988 | Hausmann | 52/461 |
| 4,845,911 | 7/1989 | Winston et al. | 52/456 |
| 4,860,517 | 8/1989 | Kipross | 52/656 |
| 4,920,718 | 5/1990 | Artwick et al. | 52/476 |
| 4,949,521 | 8/1990 | Riegelman et al. | 52/456 |
| 4,986,332 | 1/1991 | Lanuza | 52/716 |

FOREIGN PATENT DOCUMENTS

| | | | |
|---|---|---|---|
| 1430591 | 3/1936 | United Kingdom | 52/395 |

*Primary Examiner*—John E. Murtagh
*Attorney, Agent, or Firm*—Lathrop & Clark

[57] ABSTRACT

A glazing system for a wooden door or window employs coextruded vinyl trim strips which have a planar base with flexible compression members and flexible seal tubes and a projecting barb extending from the base. The trim strips engage in kerfs in the window sash and the seal tubes are compressed against the window lights by extruded aluminum trim caps which engage with the trim strip barbs and against the sash. Sashes which have more than one light separated by a wooden muntin are glazed with a vinyl extruded muntin strip which is attached to the muntin so that a flexible seal tube which is a part of the muntin strip base overlies the glass lights on each side of the muntin. An extruded aluminum muntin cap is snap-fit to the muntin strip such that the muntin strip seal tubes are compressed against the window glass. The aluminum muntin cap and trim caps substantially cover and shield the trim strips and muntin strips from exposure to sunlight.

14 Claims, 4 Drawing Sheets

WINDOW AND DOOR GLAZING SYSTEM

FIELD OF THE INVENTION

This invention relates generally to glazing assemblies for wooden windows and doors.

BACKGROUND OF THE INVENTION

Traditionally, windows and glazed doors have been fabricated from wood. Wood is a better insulator than metal, hence there is much less heat loss through a wooden window sash and frame than through a metal one. Furthermore, condensation rarely forms on wood windows. Wooden windows and doors also are easily painted or stained to provide an aesthetically pleasing appearance compatible with a building's interior decoration.

Traditional window glazing involves setting a glass pane or light into a lip cut in the wooden window sash, fixing the light to the sash with a number of nails or glazing points and sealing the lights to the sash with a putty fill. A more consistent appearance may be achieved by substituting a wooden molded glazing bead for the putty. Improved insulating properties have been achieved by using double thicknesses of glass separated by a sealed metal spacer. Wooden beads, while attractive, require upkeep and painting, and are time consuming to fit and install.

Glazing systems employing vinyl glazing strips have taken a number of forms. A vinyl glazing strip with compressible barbs may be inserted into a wooden kerf above the outer window pane to bear against the glass light and compressively seal the light to the sash. Another vinyl glazing involves an extruded vinyl boot which surrounds the edges of both panes of insulated glass and which fits in a wide slot in the sash. However, although vinyl does not require painting, it is subject to decomposition upon exposure to sunlight which results in an unattractive appearance and necessitates eventual replacement.

Wooden windows which have an exterior cladding of aluminum are well known and provide an attractive and low maintenance exterior appearance. Because of aluminum's limitated flexibility, exterior aluminum glazing strips have been employed with an elastic sealant such as butyl tape. Such a system may be costly to apply, requiring re-application of a new sealant each time the aluminum strip is removed.

Traditional wooden windows have sashes divided by one or more vertical and horizontal muntin bars into a number of smaller aperatures which are each individually glazed. These divided lights, each at a slightly different angle, have perceptibly differing reflections and surface conditions which produce an aesthetically desirable effect which cannot fully be duplicated by muntin bar assemblies which are placed over a single light.

Window glass is occasionally subject to breakage due to storms, settling and vandalism. Windows glazed with Putty or wood strips, and those encased in vinyl boots, are usually damaged when the broken glass is removed.

What is needed is a glazing system for wooden windows and doors which may be quickly installed and replaceably removed, which presents a low maintenance and attractive exterior and which will economically accommodate divided lights.

SUMMARY OF THE INVENTION

The exterior glazing system for a window or door of this invention has a number of extruded vinyl and aluminum strips which are assembled with the window sash having window openings divided by a wooden muntin and is adapted to secure glass lights within the window sash. The system has an extruded plastic trim strip with a planar base and a bar which projects away from the base. A flexible Plastic tube is integrally attached to the base and a deformable member projects from the base opposite the flexible tube. The deformable member is adapted to engage within a kerf in the sash to engage the trim strip with the sash. A metal trim cap has a planar portion and a barb which extends from the planar portion and which is adapted to engage with the trim strip barb in snap-fit relation to space the trim cap planar portion from the strip base. The cap planar portion has an outwardly extending inclined compression member which is adapted to engage against the plastic tube of the trim strip base such that when the strip is engaged with the window sash, the cap planar portion is spaced from the glass light and the compression member compresses the flexible tube against the glass light and forms a seal between the strip and the light. For glazing windows having a muntin dividing the sash and at least two glass lights within the sash, the system has an extruded plastic muntin strip which is attached to the window muntin to partially overlie at least two glass lights. The strip has a planar base with a central portion adapted for attachment to the muntin and portions extending on either side of the central portion which overlie the glass lights. The strip also has a projecting barb which extends from the central portion of the base away from the muntin and flexible plastic tubes which are integrally attached to the extending portions of the base. A metal muntin cap is adapted for engagement with the muntin strip. The muntin cap has a top and a protruding barb projecting from the top which is adapted to engage with the strip projecting barb to space the top from the strip base. The muntin cap also has inclined compression members which extend on either side of the planar portion. The compression members are adapted to engage against the plastic tubes of the strip base such that when the strip is attached to the window muntin the compression members compress the flexible tubes against the glass lights and form a tight seal. The metal trim and muntin caps when engaged with the vinyl trim and muntin strips substantially cover and shield the strips from exposure to sunlight.

It is an object of the present invention to provide a glazing system for windows and doors which may be rapidly snapped into place requiring a minimum of tools.

It is also an object of the present invention to provide a glazing system for windows and doors which is not subject to significant deterioration from exposure to sunlight.

It is another object of the present invention to provide a glazing system for windows and doors which is adaptable to any desired number of lights within a sash.

It is a further object of the present invention to provide a glazing system for windows and doors which may be nondistructively removed and reinstalled to facilitate replacement of glass lights.

Further objects, features and advantages of the invention will be apparent from the following detailed description when taken in conjunction with the accompanying drawings.

DESCRIPTION OF THE PREFERRED EMBODIMENT

Figure 1:
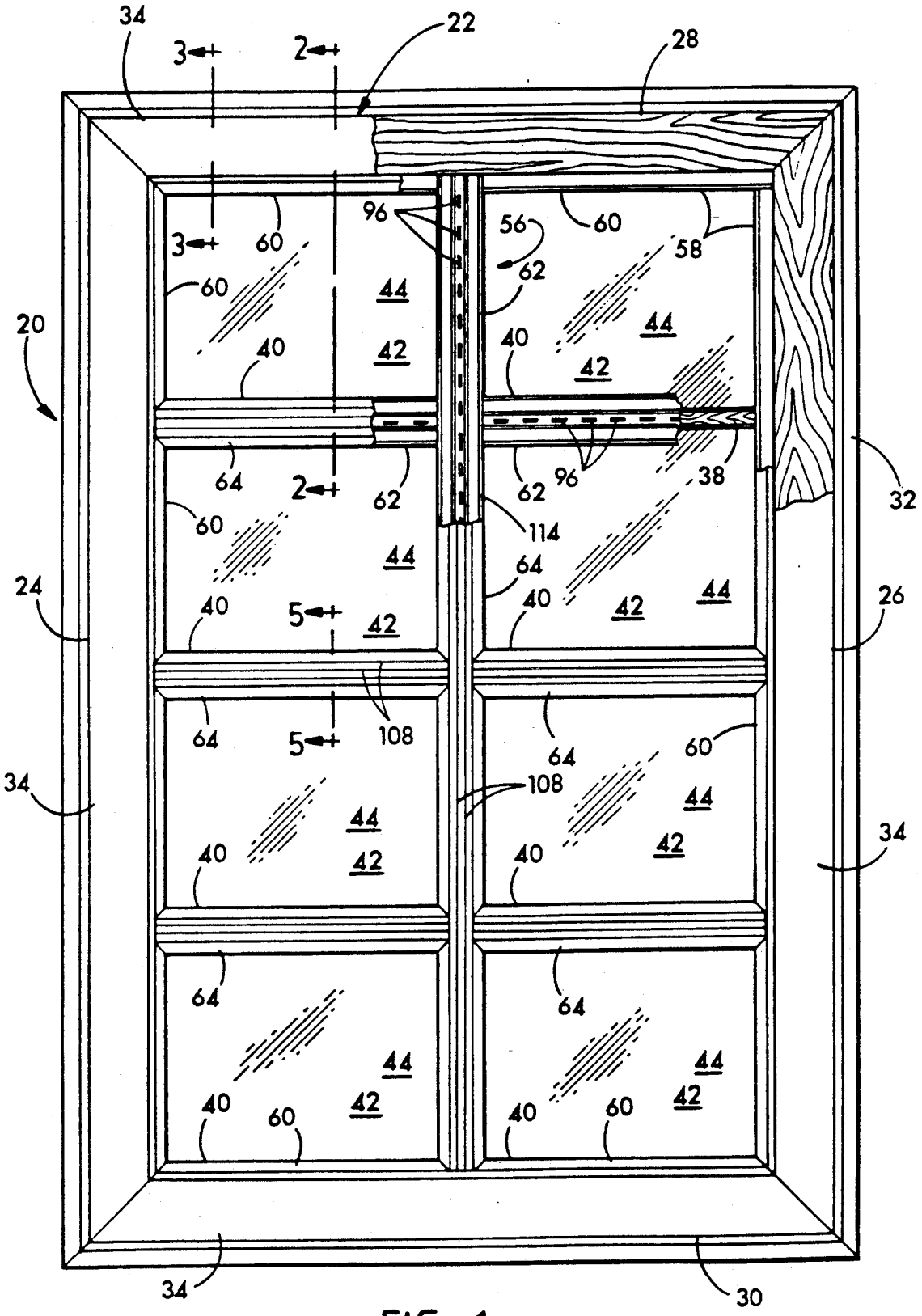
FIG. 1 is a front elevational view of a window glazed with the glazing system of this invention, with the aluminum cladding broken away in portions.

Referring now to FIGS. 1-6, wherein like numbers refer to similar parts, an exemplary window 20 glazed with the exterior glazing system of this invention is best shown in FIG. 1. The window 20 is a conventional casement window fabricated of wood such as ponderosa pine or white pine, or any other appropriate wood. The window 20 has a wooden sash 22 formed by an upright left stile 24, and right stile 26 joining a horizontal upper rail 28 and a bottom rail 30. The sash 22 is mounted in the frame 32 which has been appropriately installed in an exterior wall (not shown) of a building.

Figure 3:
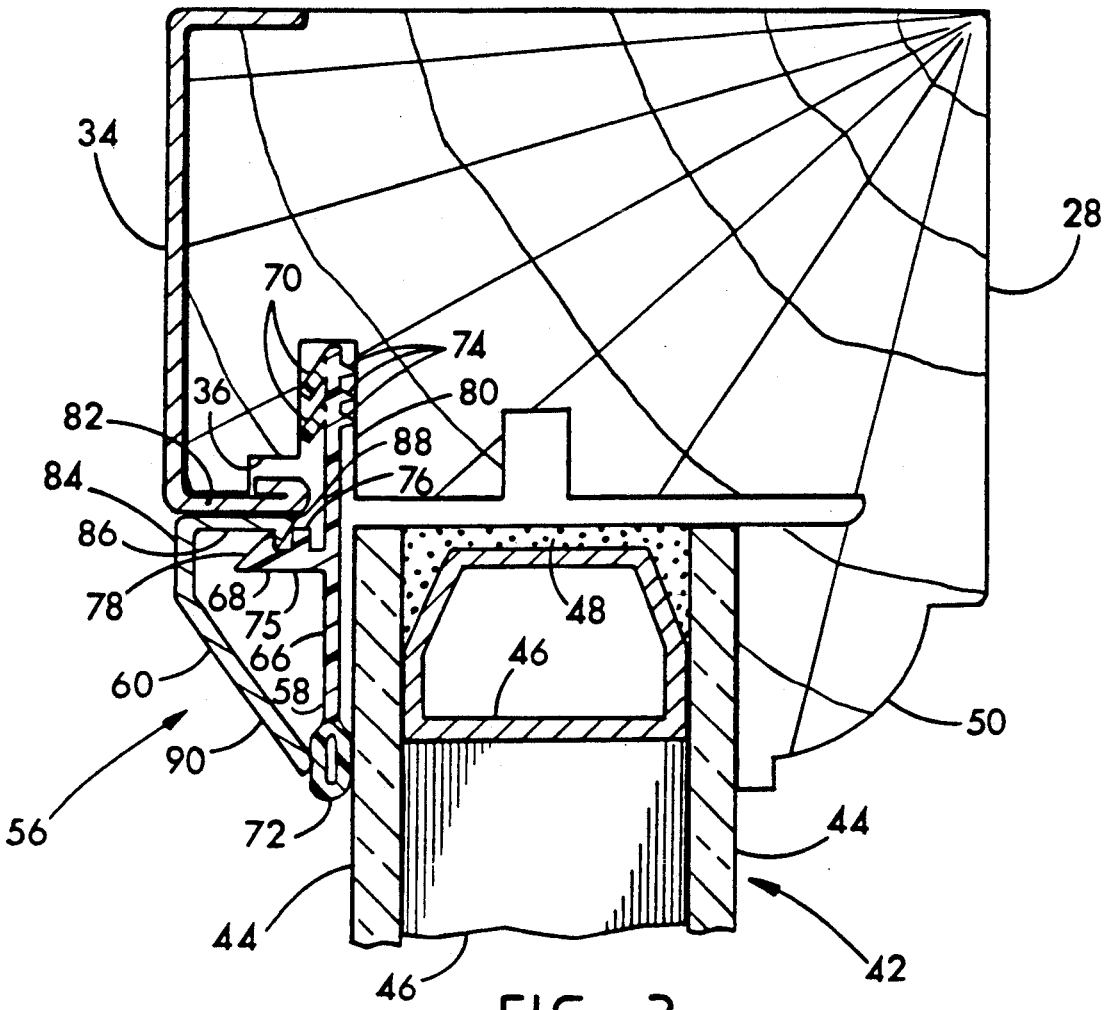
FIG. 3 is a fragmentary cross-sectional view of the window of FIG. 1 taken along section 3—3.

The sash 22 is clad with an aluminum cladding 34 of a desired color in a conventional manner. As best shown in FIG. 3, the aluminum cladding 34 wraps around the members 24, 26, 28, 30 of the sash and engages in a cutaway 36. The interior of the sash 22 is not clad leaving the wood exposed for painting or finishing as desired.

Wooden muntins subdivide the sash 22 into a number of rectangular openings 40. Each opening 40 is filled with a transparent light 42. A light is composed of two glass panes 44 which are spaced from one another by aluminum spacing bars 46 which are sealed by a sealant 48.

On the sash interior, the stiles 24, 26 and rails 28, 30 have a protruding molding 50 against which the lights are held by the glazing system 56. The muntins 38 also have moldings 52 which extend on either side of a narrow muntin member 54.

Figure 2:
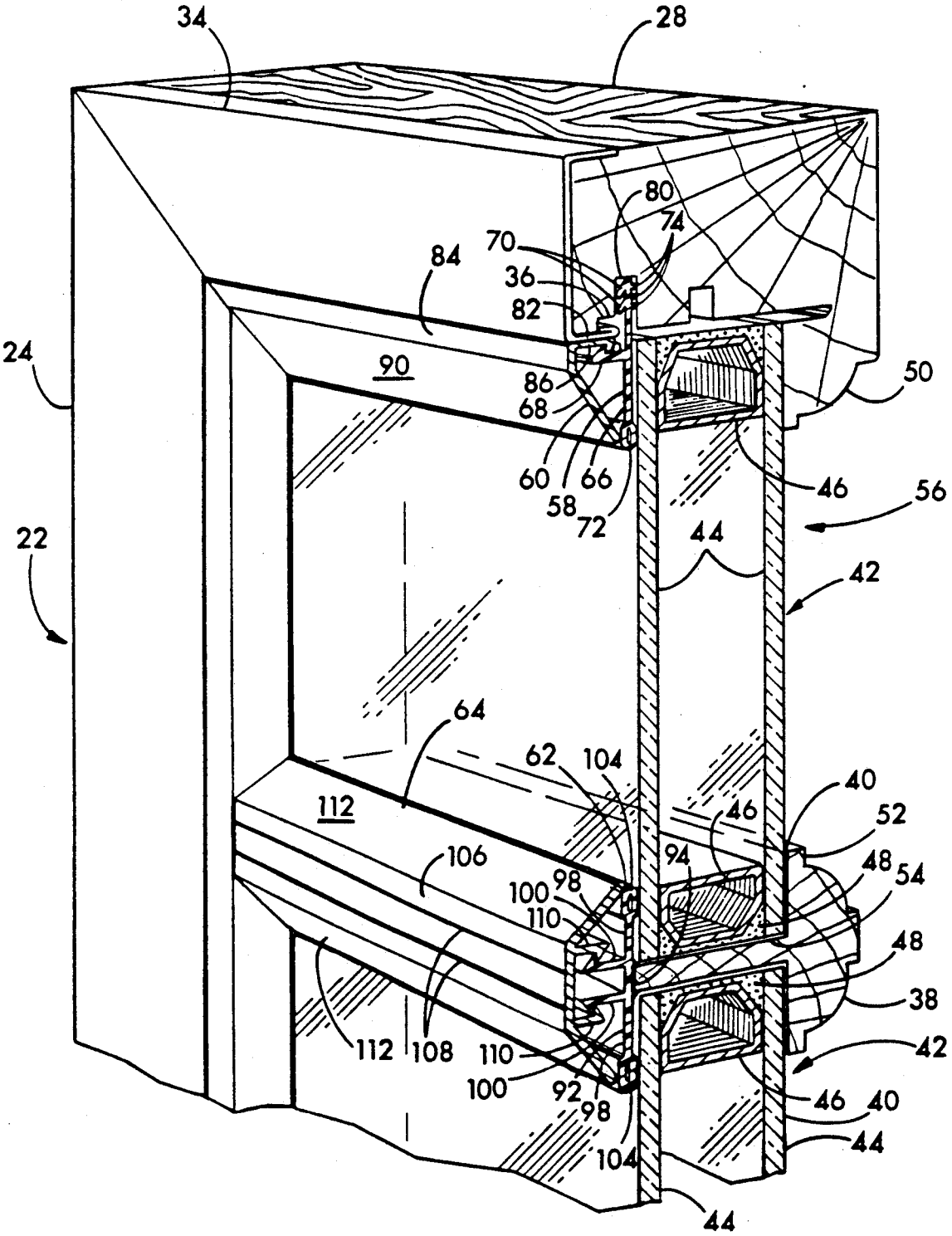
FIG. 2 is an isometric cross-sectional view of the window of FIG. 1 taken along section line 2—2.

The lights 42 are held in place and sealed against the sash 22 and muntins 38 by the glazing system 56. As best shown in FIG. 2, the glazing system 56 has four elements: trim strips 58, trim caps 60, muntin strips 62 and muntin caps 64. The trimp strips 58 and trimp caps 60 cooperate to hold the lights 42 against the sash 22, and the muntin strips 62 and muntin caps 64 cooperate to hold the lights 42 against the muntins 38.

Figure 4:
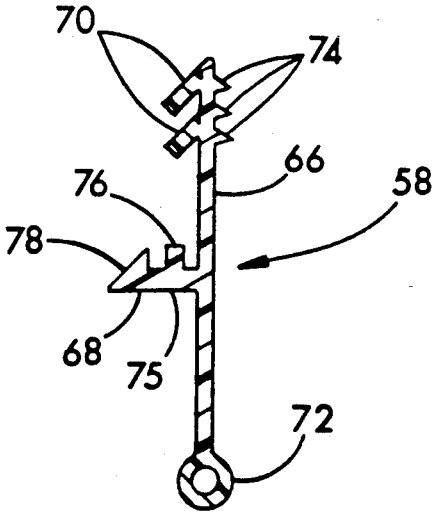
FIG. 4 is a cross-sectional view of the vinyl trim strip of the glazing system of FIG. 3 shown in its uncompressed form.

A trim strip 58 is formed of two varieties of coextruded vinyl. As best shown in FIG. 4, the trim strip 58 has a constant cross-section and has a planar base 66 and a projecting barb 68 which extends away from the base 66. On the sash side of the base 66 are located two deformable members 70 which are inclined towards the projecting barb 68. Also attached to the base 66 opposite the deformable members 70 is a flexible seal tube 72. The deformable members 70 and the seal tube 72 although extruded as unitary portions of the trim strip 58, are composed of a vinyl material which is flexible and substantially less rigid than the vinyl material which forms the base 66 and the projecting barb 68. Three protruding ribs 74 are located on the base 66 beneath the deformable members 70 and are extruded of the less flexible vinyl material. The projecting barb 68 has an upright portion 75 with a linear stop 76 located beneath the triangular head 78 of the barb 68.

As best shown in FIG. 3, the trim strip 58 is engaged with the sash 22 by inserting the portion of the base 66 with the deformable members 70 and the ribs 74 into a kerf 80 which is located in the sash stiles 24, 26 and rails 28, 30. The kerf 80 is spaced from the sash moldings 50 approximately a distance equal to the thickness of the lights 42. The kerf 80 is sufficiently deep such that when the base 66 of the trim strip 60 is inserted into the kerf 80 the projecting barb 68 will be closely spaced from the wrapped around portion 82 of the aluminum cladding 34. The kerf 80 is narrower than the distance between the tops of the deformable members 70 and the ribs 74. Hence, when the base 66 is inserted into the kerf 80, the deformable members are deformed downwardly against the base 66, and the base is frictionally engaged with the sash 22.

The trim cap 60 is an extruded aluminum member of constant cross-section which has a planar portion top 84 which is spaced from and generally parallel to the trim strip base 66 when installed. A barb extends from the planar portion 84 and has a wedge shaped head 88. The trim cap barb 86 engages with the projecting barb 68 of the trim strip 58 in snap-fit relation against the wrapped-around portion 82 of the aluminum cladding 34. The stop 76 on the projecting barb 68 of the base 66 serves to properly space the trim cap 60 from the surface of the light 42. The trim cap further has an outwardly extending inclined compression member 90 which engages with the seal tube 72 of the trim strip base 66. The compression member 90 is inclined at approximately 45° from the planar portion 84. The trim cap 60 is abutted against the wrapped-around portion 82 of the aluminum cladding and is thus locked into position.

When the trim cap 60 is engaged with the trim strip 58, the cap planar portion 84 is spaced from the light 42 and the compression member 90 compresses the flexible seal tube 72 against the glass light 42,.holding the light 42 against the sash 22 and forming a tight seal. As best shown in FIG. 3 the linear compression member 90 presses against the seal tube 72 approximately at the center of the tube, thus deforming the generally cylindrical seal tube 72 into a more flattened shape which bears against the glass of the light 42 and forms a barrier against air, dust and vapor.

It is important to note that when the aluminum trim cap 60 is engaged with the vinyl trim strip 58, the trim cap 60 substantially completely covers the trim strip 58 and shields the trim strip 58 from any exposure to sunlight which would tend to cause breakdown and deterioration of the vinyl material.

As best shown in FIG. 2, the lights 42 are held in place and sealed against the muntins 38 by the muntin strips 62 and muntin caps 64.

Figure 6:
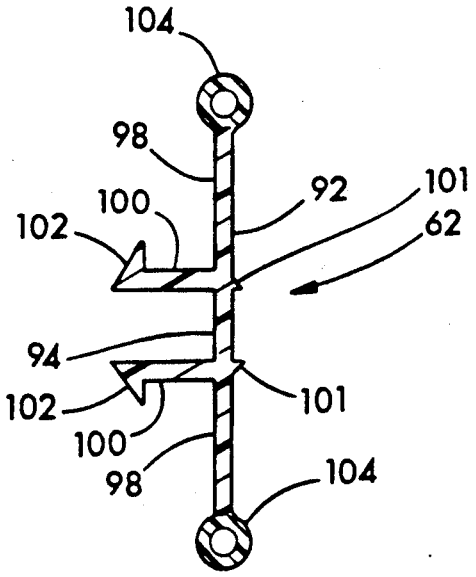
FIG. 6 is a cross-sectional view of the muntin strip of the glazing system of FIG. 5 in its uncompressed form.

As best shown in FIG. 6, each muntin strip 62 is formed of two varieties of vinyl coextruded to form a unitary element. The muntin strip 62 has a planar base 92 with a central portion which is attached to the narrow muntin member 54 of a muntin 38 by staples 96. The base 92 has portions 98 which extend on either side of the central portion 94 and overlie the glass lights 42.

Two barbs 100 project upwardly from the base 92 and terminate in wedge-shaped heads 102. On the muntin-side of the muntin strip 52 are located two protruding ridges 101. The ridges are located on either side of the muntin member 54 and assist the correct placement of the muntin strip 62 on the muntin members 54. A flexible plastic seal tube 104 is located at the end of each extending portion 98 of the base 92. The seal tubes 104 are coextruded with the barbs 100 and the base 92, but are formed of a vinyl material which is substantially more flexible than that of the rest of the muntin strip 62.

Figure 5:
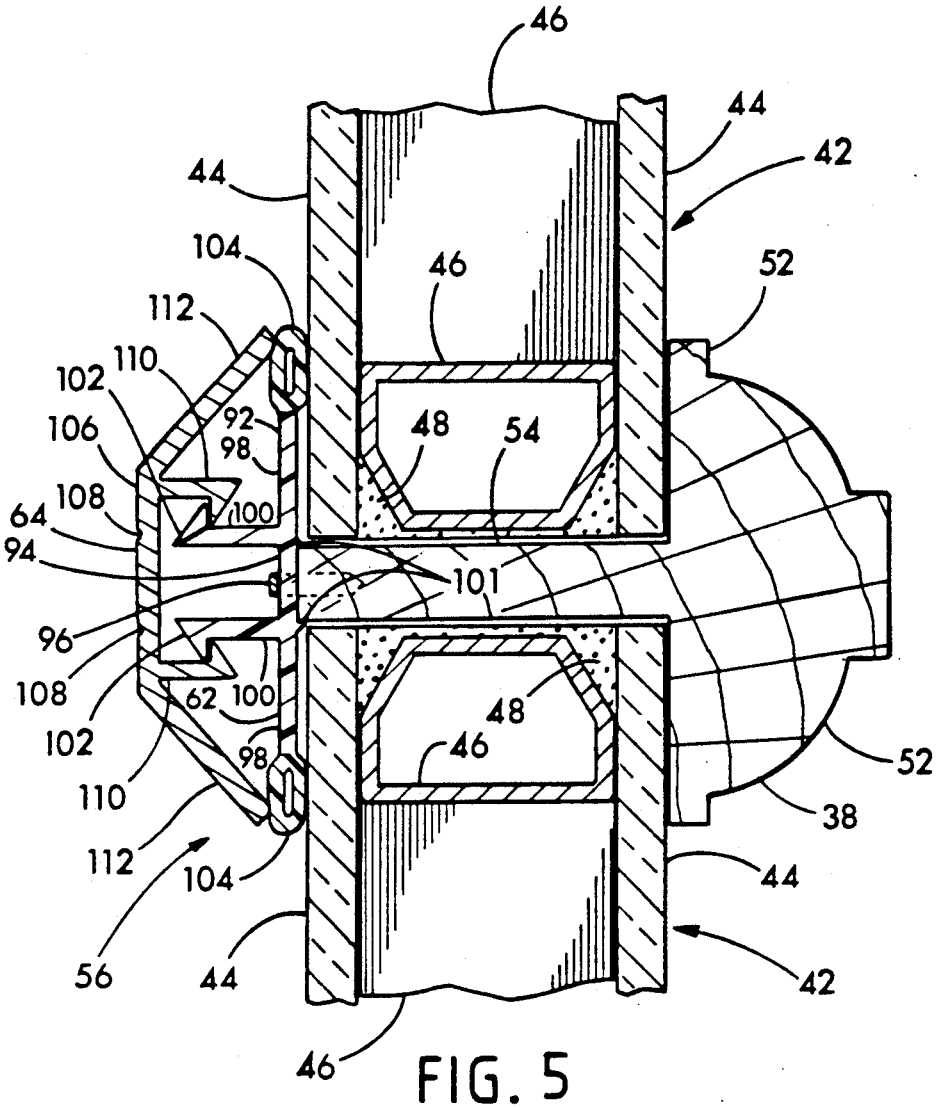
FIG. 5 is a fragmentary cross-sectional view of the window of FIG. 1 taken along section line 5—5.

Each muntin cap, as best shown in FIG. 5, is formed of extruded aluminum and has a planar portion top 106 with a number of decorative narrow reveals 108 which add visual interest to the planar portion surface 106. Two barbs 110 project beneath the planar portion 106 and engage with the barbs 100 which project from the base 92 of the muntin strip 62. Inclined compression members 112 extend on either side of the planar portion 106. When the muntin cap 64 is engaged with the muntin strip 62 by the snap-fit engagement of the muntin cap barbs 110 and the muntin strip barbs 100, the compression members 112 are brought into contact with the seal tubes 104 of the muntin strip to compress the flexible tubes 104 against the glass lights 42, thereby holding the glass lights 42 against the window muntins 38 and forming a tight seal. When the metal muntin caps 64 are engaged with the muntin strips 62, the aluminum muntin caps 64 substantially cover and shield the vinyl muntin strips 62 from exposure to sunlight.

A window sash of any dimensions, divided into any desired number of openings and having any number of lights may be effectively glazed by the glazing system 56 by employing an appropriate selection of trim strips 58, trim caps 60, muntin strips 62, and muntin caps 64, each cut to appropriate length and shaped where necessary.

To glaze the window 20 with the glazing system 56 the lights 42 are fitted into the openings 40 where they are supported by the sash and muntin moldings 50, 52. A single continuous muntin strip 62 is stapled to the central vertical muntin 114. Smaller muntin strip segments are then stapled to the remaining horizontal muntins 38. Continuous vertical trim strips 58 are inserted in the kerfs 80 along the left and right stiles 24, 26 and additional trim strips are fixed to the upper and bottom rails 28, 30. With the trim strips 58 and the muntin strips 62 in place over the lights 42, the muntin caps 64 and trim caps 60 may then be pressed into place to securely seal the lights 42 into the sash 22.

A continuous vertical muntin cap 64 is pressed down onto the muntin strip 62 attached to the vertical muntin 114 and snapped into position. Continuous vertical trim caps 60 are snapped into place against the left and right stiles, 24, 26 and the remaining muntin caps 64 and trim caps 60, which have been manufactured with beveled ends are snapped into place.

Because of the speed and ease of glazing utilizing the glazing system 56, a retailer or builder may maintain a large inventory of wooden windows unglazed and unclad. When a particular customer specifies the color of aluminum cladding which he desires, windows may rapidly be prepared to the desired specifications. In this way a builder or contractor may rapidly prepare and deliver glazed windows with desired specifications without the need for maintaining an inventory of every possible color of glazed window. Reduced inventory costs are thus obtained. It is important to note that, while an eight-light casement window has been illustrated, the glazing system of this invention is equally applicable to double hung sash, fixed, and other types of windows with any number of lights. Furthermore, the glazing system will also be advantageously employed in glazing doors.

Furthermore, although the muntin strips and muntin caps allow effective glazing of sashes with divided lights, the trim strips and trim caps may be utilized in sashes 22 which have only a single light. Additionally, the trim strips and trim caps may be used to glaze windows which are painted or clad in vinyl or some other material.

Furthermore, althought the glazing system has been illustrated in conjunction with double pane glass lights, it will be equally applicable to windows employing single thickness glass lights.

It should be noted that although the planar portion tops of the trim caps and the muntin caps have been shown as planar portions, the tops may be angled, curved or any other desired shape to achieve a particular desired appearance. Although a pair of barbs are shown projecting from the muntin strip, a single barb with a double head may also be effective.

It is understood that the invention is not confined to the particular construction and arrangement of parts herein illustrated and described but embraces such modified forms thereof as come within the scope of the following claims.

I claim:

1. An exterior glazing system for a wooden window or door having a sash with a light; comprising:

a) an extruded vinyl strip adapted to engage with the wooden window, the strip having a planar base and a barb projecting from the base; wherein the base has a flexible vinyl tube integrally attached thereto, the tube being adapted to overlie and press against the light;

b) an extruded metal cap having a projecting barb adapted to engage with the strip projecting barb in snap-fit relation, wherein the cap has a compression member extending towards the strip from the barb, wherein the compression member is adapted to press against the vinyl tube of the strip when the cap is engaged with the strip to compress the tube against the light and to form a seal between the strip and the light, wherein the cap is adapted to substantially cover the strip and shield the strip from exposure to sunlight.

2. An exterior glazing system for a window or door having a sash, and a light within the sash, the system comprising:

a) an extruded plastic strip having a planar base, a barb projecting away from the base, and a flexible plastic tube affixed to the base, wherein the base has a deformable member projecting from the base opposite the flexible tube, the deformable member being adapted to engage within a kerf in the sash, to engage the strip with the sash; and b) a metal cap adapted for engagement with the strip, the cap having a top and a barb extending from the top, the cap barb being adapted to engage with the strip barb in snap-fit relation to space the cap top from the strip base, and the cap top has a compression member which extends toward the strip base and which is adapted to engage against the plastic tube of the strip base, such that when the strip is engaged with the window sash, the cap top is spaced from the light and the compression member compresses the flexible tube against the light, and forms a seal between the strip and the light, and wherein the metal cap when engaged with the strip substantially covers and shields the strip from exposure to sunlight.

3. The glazing system of claim 2 wherein the compression member extends from the top of the metal cap at an angle of approximately 45°.

4. The glazing system of claim 2 wherein the plastic is integrally formed of a first plastic material and a second plastic material, wherein the second plastic material is more flexible than the first plastic material, and the base and projecting barb are formed of the first plastic material and the flexible tube and the deformable member are formed of the second plastic material.

5. The glazing system of claim 2 wherein the projecting barb of the plastic strip has an upright portion terminating in a wedge-shaped head, and a protruding stop projects from the upright portion of the barb and is spaced below the head to properly space the trim cap from the light when the trim cap barb is engaged between the head and the stop.

6. An exterior glazing system for a window or door having a sash, a muntin dividing the sash, and at least two glass lights within the sash, the system comprising:

a) an extruded plastic muntin strip adapted for attachment to the window muntin to partially overlie at least two glass lights, the strip having a planar base with a central portion adapted for attachment to the muntin, and portions extending on either side of the central portion adapted to overlie the glass lights, the strip also having a projecting barb which extends from the central portion of the base away from the muntin, and flexible plastic tubes are integrally attached to the extending portions of the base; and b) a metal muntin cap adapted for engagement with the muntin strip, the muntin cap having a top and a protruding barb projecting from the top and adapted to engage with the strip projecting barb to space the top from the strip base, the muntin cap also having compression members extending on either side of the planar portion, the compression members being adapted to engage against the plastic tubes of the strip base such that when the strip is attached to the window muntin, the compression members compress the flexible tubes against the lights, and form a seal between the strip and the lights, and wherein the metal cap when engaged with the strip substantially covers and shields the strip from exposure to sunlight.

7. The glazing system of claim 6 wherein the plastic muntin strip is formed of a first plastic material and a second plastic material, wherein the second plastic material is more flexible than the first plastic material, and the base and projecting barb are formed of the first plastic material and the flexible tubes are formed of the second plastic material.

8. The glazing system of claim 6 wherein the muntin strip has two projecting barbs, one located on either side of the top, and the muntin cap has two projecting barbs that engage with the muntin strip projecting barbs.

9. The glazing system of claim 6 wherein the compression members extend from the top of the muntin cap at an angle of approximately 45°.

10. A window comprising:

a) a wooden sash having a left stile, a right stile, an upper rail, and a lower rail;

b) a wooden muntin extending from the upper rail to the lower rail wherein two openings are defined by the sash and the muntin;

c) a light inserted in each opening, wherein each light is supported by portions of the sash and the muntin;

an extruded plastic muntin strip having a central portion attached to the muntin, and portions extending on either side of the central portion which overlie the lights, the strip having a projecting barb which extends from the central portion of the base away from the muntin, and flexible plastic tubes affixed to the extending portions of the base and engaged against the glass lights;

e) a metal muntin cap having a planar portion and a protruding barb projecting from the planar portion and inclined compression members extending from either side of the planar portion, wherein the muntin cap is engaged with the muntin strip in a snap-fit relation, and the compression members are engaged against the plastic tubes of the strip base to compress the flexible tubes against the lights, and form a seal between the muntin strip and the lights;

f) a plurality of extruded plastic trim strips, each trim strip having a planar base, a barb projecting away from the base, and a flexible plastic tube integrally attached to the base, and a deformable member projecting from the base opposite the flexible tube, and the trim strips are engaged in a kerf in the sash such that the deformable member is deformed within the kerf in the sash to frictionally engage the strips with the sash;

g) a plurality of metal trim caps having a planar portion and a barb extending from the planar portion towards the glass lights, the trim cap barb engaging with the trim strip barb in snap-fit relation to lock the metal trim caps against the lights, the trim caps having an outwardly extending compression member which engages against the plastic tube of the trim strip base, such that the plastic tube of the trim strip is compressed against the light, and a tight seal is formed thereby.

11. The glazing system of claim 10 wherein the compression member extends from the planar portion of the metal trim cap at an angle of approximately 45°.

12. The glazing system of claim 10 wherein the plastic trim strip and muntin strips are integrally formed of a first plastic material and a second plastic material, wherein the second plastic material is more flexible than the first plastic material, and the base and projecting barb of the trim and muntin strips are formed of the first plastic material and the flexible tubes are formed of the second plastic material.

13. The glazing system of claim 10 wherein the projecting barb of the trim strip has an upright portion terminating in a wedge-shaped head, and a protruding stop projects from the upright portion of the barb and is spaced below the head to properly space the trim cap from the light when the trim cap barb is engaged between the head and the stop.

14. The glazing system of claim 10 wherein the muntin strip has two projecting barbs, one located on either side of the central portion, and the muntin cap has two projecting barbs that engage with the muntin strip projecting barbs.

* * * * *

UNITED STATES PATENT AND TRADEMARK OFFICE

CERTIFICATE OF CORRECTION

PATENT NO. : 5,088,255

DATED : February 18, 1992

INVENTOR(S) : Emanuel

It is certified that error appears in the above-identified patent and that said Letters Patent is hereby corrected as shown below:

Column 7, line 10, "plastic is" should be -- plastic strip is --.

Column 8, line 9, insert -- (d) -- before "an extruded".

Signed and Sealed this

Twenty-ninth Day of June, 1993

*Attest:*

Michael K. Kirk

MICHAEL K. KIRK

*Attesting Officer*

*Acting Commissioner of Patents and Trademarks*